US009267244B2

(12) United States Patent
Bennett et al.

(10) Patent No.: US 9,267,244 B2
(45) Date of Patent: Feb. 23, 2016

(54) SYNTHETIC GRASS TILE SYSTEM AND METHOD

(71) Applicants: Ron Bennett, Dalton, GA (US); Steve White, Jr., Dalton, GA (US)

(72) Inventors: Ron Bennett, Dalton, GA (US); Steve White, Jr., Dalton, GA (US)

(73) Assignee: WHOLESALE TURF SUPPLY LLC, Dalton, GA (US)

( * ) Notice: Subject to any disclaimer, the term of this patent is extended or adjusted under 35 U.S.C. 154(b) by 0 days.

(21) Appl. No.: 14/212,066

(22) Filed: Mar. 14, 2014

(65) Prior Publication Data

US 2014/0286704 A1 Sep. 25, 2014

Related U.S. Application Data

(60) Provisional application No. 61/794,153, filed on Mar. 15, 2013.

(51) Int. Cl.

| | |
|---|---|
| ***E01C 13/08*** | (2006.01) |
| ***E01C 5/22*** | (2006.01) |
| ***E01C 11/22*** | (2006.01) |

(52) U.S. Cl.

CPC . *E01C 13/08* (2013.01); *E01C 5/22* (2013.01); *E01C 11/225* (2013.01); *E01C 2201/12* (2013.01); *Y10T 156/10* (2015.01); *Y10T 156/1052* (2015.01)

(58) Field of Classification Search

CPC ..... E04B 2/00; E04F 15/00; E01C 5/00; E01C 5/20; E01C 13/08; E01C 5/22; E01C 11/225; E01C 2201/12

See application file for complete search history.

(56) References Cited

U.S. PATENT DOCUMENTS

| | | | | |
|---|---|---|---|---|
| 3,735,988 | A | 5/1973 | Palmer et al. | |
| 4,902,540 | A * | 2/1990 | Martino | 428/17 |
| 5,323,575 | A * | 6/1994 | Yeh | 52/177 |
| 5,628,160 | A * | 5/1997 | Kung | 52/591.1 |
| 6,751,912 | B2 * | 6/2004 | Stegner et al. | 52/177 |
| 6,802,159 | B1 * | 10/2004 | Kotler | 52/177 |
| 7,114,298 | B2 * | 10/2006 | Kotler | 52/177 |
| 7,516,587 | B2 | 4/2009 | Barlow | |
| 7,698,859 | B2 * | 4/2010 | Sansano Marti | 52/177 |
| 7,930,865 | B2 | 4/2011 | Barlow | |
| 7,955,025 | B2 | 6/2011 | Murphy et al. | |
| 8,141,314 | B2 | 3/2012 | Rosan | |
| 8,266,857 | B2 | 9/2012 | David | |
| 2004/0058096 | A1 * | 3/2004 | Prevost | 428/17 |
| 2006/0260264 | A1 * | 11/2006 | Reynolds | 52/745.1 |
| 2006/0283118 | A1 * | 12/2006 | Moller, Jr. | 52/403.1 |
| 2006/0283125 | A1 * | 12/2006 | Moller, Jr. | 52/578 |
| 2007/0289244 | A1 * | 12/2007 | Haney et al. | 52/539 |
| 2008/0092473 | A1 | 4/2008 | Heyns | |
| 2009/0178367 | A1 | 7/2009 | Barlow | |
| 2012/0110804 | A1 * | 5/2012 | Hussmann | 28/100 |

* cited by examiner

*Primary Examiner* — Abigail A Risic

(74) *Attorney, Agent, or Firm* — Lathrop & Gage LLP

(57) ABSTRACT

A synthetic grass tile system and method are disclosed. An artificial turf tile system has a plurality of connectable tile members and a synthetic turf arrangement adhered to the tile members. The interconnected tile members, having the turf attached thereto, are cut into sections. The sections are then secured on a pallet for sale at a retail establishment. A method for producing a modular synthetic grass tile system follows the following steps: (a) providing a plurality of tile members; (b) snapping the tile members together at their edges to form a grid; and (c) adhering a sheet of synthetic turf to the top surface of the tile members.

17 Claims, 8 Drawing Sheets

SYNTHETIC GRASS TILE SYSTEM AND METHOD

CROSS-REFERENCE TO RELATED APPLICATIONS

This application claims the benefit of U.S. Provisional Application 61/794,153, filed on Mar. 15, 2013, the disclosure of which is incorporated in its entirety by reference herein.

FIELD OF THE INVENTION

The invention relates generally to the field of landscaping and related products. More specifically, the invention relates to artificial turf installation systems.

BACKGROUND OF THE INVENTION

The use of artificial turf as an alternative to real grass has been known for some time. Artificial turf is typically provided for installation in rolls. In some applications, artisans use tiles or other sub-turf supporting mechanisms deployed above a ground or concrete surface. The artificial turf is then unrolled and secured atop the supporting mechanism. In other applications, the turf may be directly secured onto a prepared surface, such as concrete.

These conventional installation methods and systems often require professional installation teams to work considerable hours per project. This substantially increases the cost and results in scheduling difficulties. Furthermore, should the turf ever need to be replaced, additional time and money would be lost, as the installers would have to remove the old turf and re-apply the new turf.

SUMMARY

A process of providing a palletizable artificial turf installation system is disclosed which enables affordable and simple installation. In one embodiment, an artificial turf tile system has a plurality of connectable tile members and a synthetic turf arrangement adhered to the tile members. The interconnected tile members, having the turf attached thereto, are cut into sections. The sections are then secured on a pallet for sale at a retail establishment.

In another embodiment, a method for producing a modular synthetic grass tile follows the following steps: (a) providing a plurality of tile members; (b) snapping the tile members together at their edges to form a grid; and (c) adhering a sheet of synthetic turf to the top surface of the tile members.

DETAILED DESCRIPTION

Figure 1:
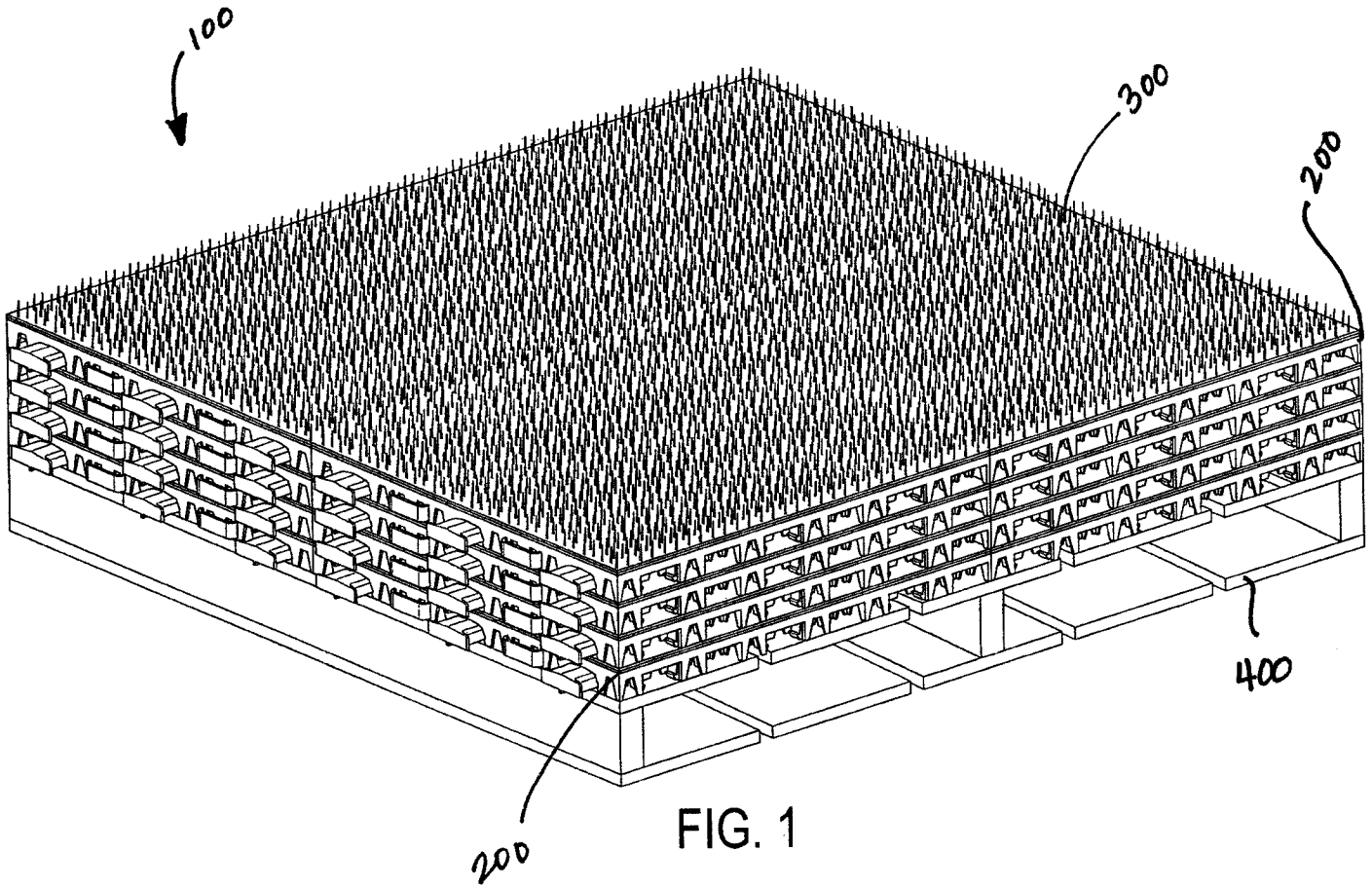
FIG. 1 is a top perspective view of an artificial turf and tile system according to one embodiment of the invention.

Embodiments of the present invention provide a system and method for creating, installing and marketing a synthetic grass product suitable for indoor or outdoor use. With reference to FIG. 1, the system 100 may be comprised of a set of interlocking tile members 200, a synthetic material arrangement 300 coupled to the tile members 200, and a pallet 400.

Figure 2A:
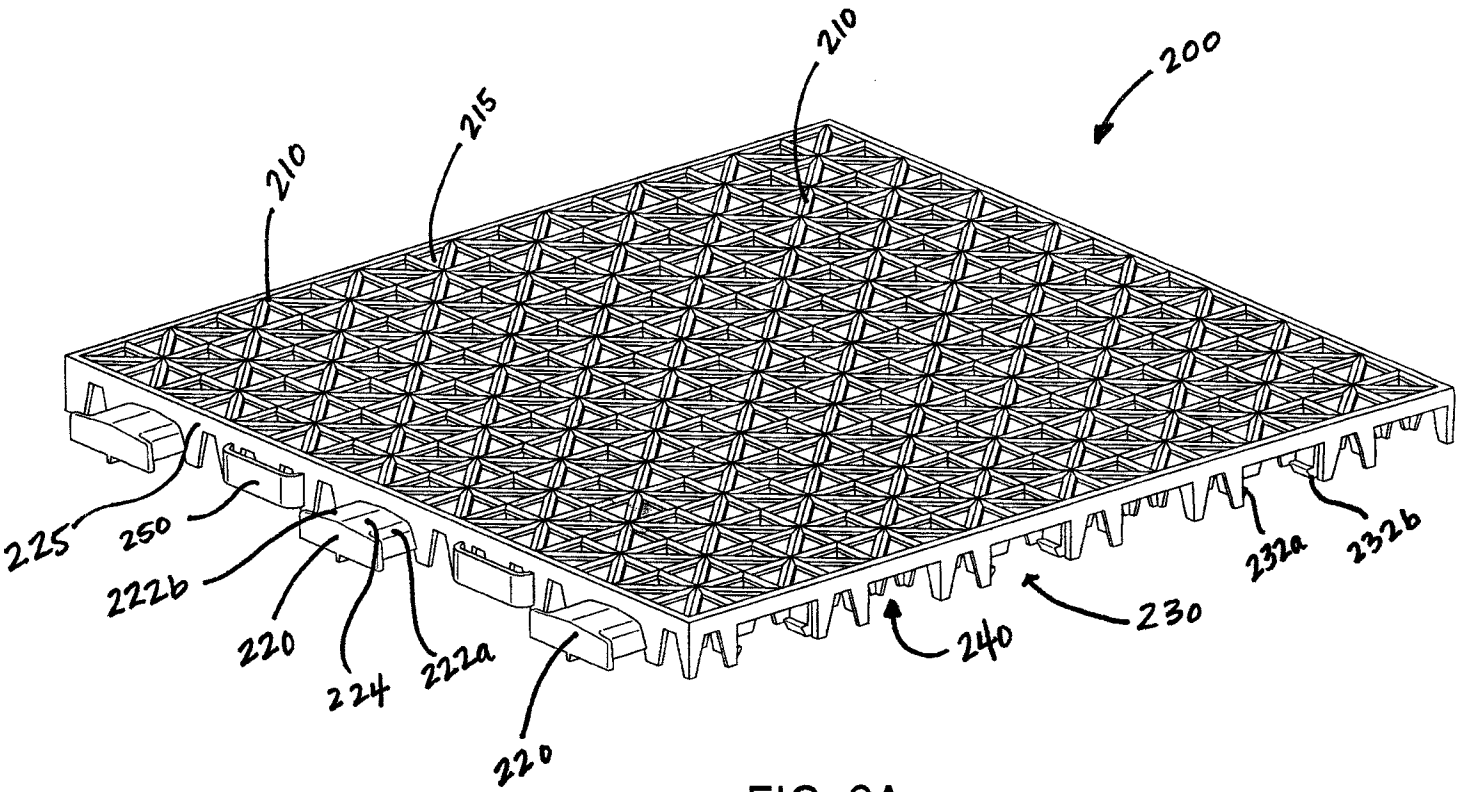
FIG. 2A is a perspective view of an tile member of the turf and tile system of FIG. 1.

As shown in FIG. 2A, each interlocking tile member 200 may have a top surface 210, at least one male coupler 220, at least one female coupler 230, and a support structure 240 disposed beneath the top surface 210. The top surface 210 may have a skeletal design providing a surface upon which adhesive coating and synthetic turf 300 may be adhered while allowing water to seep through the synthetic turf 300.

Male couplers 220 may be provided along two adjacent sides of the tile members 200. Alternately, male couplers 220 may be provided on a single side or two opposing sides of the tile member 200. The male couplers 220 may extend outward from and perpendicular to, a margin face 225 of the tile member 200. The margin face 225 runs around a perimeter of the tile member 200 to support the male couplers 220. Apertures 222 for receiving the female coupler 230 may be provided on either longitudinal side of the male coupler 220, thereby forming a central portion 224.

Female couplers 230 are configured to mesh closely with male couplers 220 to secure the tile members 200 together. Each female coupler 230 may be comprised of two spring latches 232*a*, 232*b*. The spring latches 232*a*, 232*b* may be inserted into the apertures 222*a*, 222*b* of the male couplers 220. The female couplers 230 and snap into place, whereby the spring latches 232*a*, 232*b* hook around the central portion 224 of the male coupler 220. When the male coupler 220 and the female coupler 230 are engaged, the central portion 224 fits snugly between the spring latches 232*a*, 232*b* and the tile members 200 are connected.

Additionally, a stopper 250 may be located between the male couplers 220. The stopper 250 pushes neighboring tile members 200 apart allowing for space between the members 200. Therefore, as the members 200 expand and contract with variations in temperature and/or pressure, the members 200 have room to temporarily deform from an initial shape without crumpling, and may subsequently return to their initial shape.

To facilitate joinder of multiple tile members 200, the female couplers 230 are positioned on the sides of the tile member 200 without male couplers 220. In this way, numerous tile members 200 can be joined together by matching a side with female couplers 230 to a side with male couplers 220 and snapping them together in the manner described above. The tile members 200 may be separated by unsnapping the female couplers 230 from the male couplers 220.

Figure 2B:
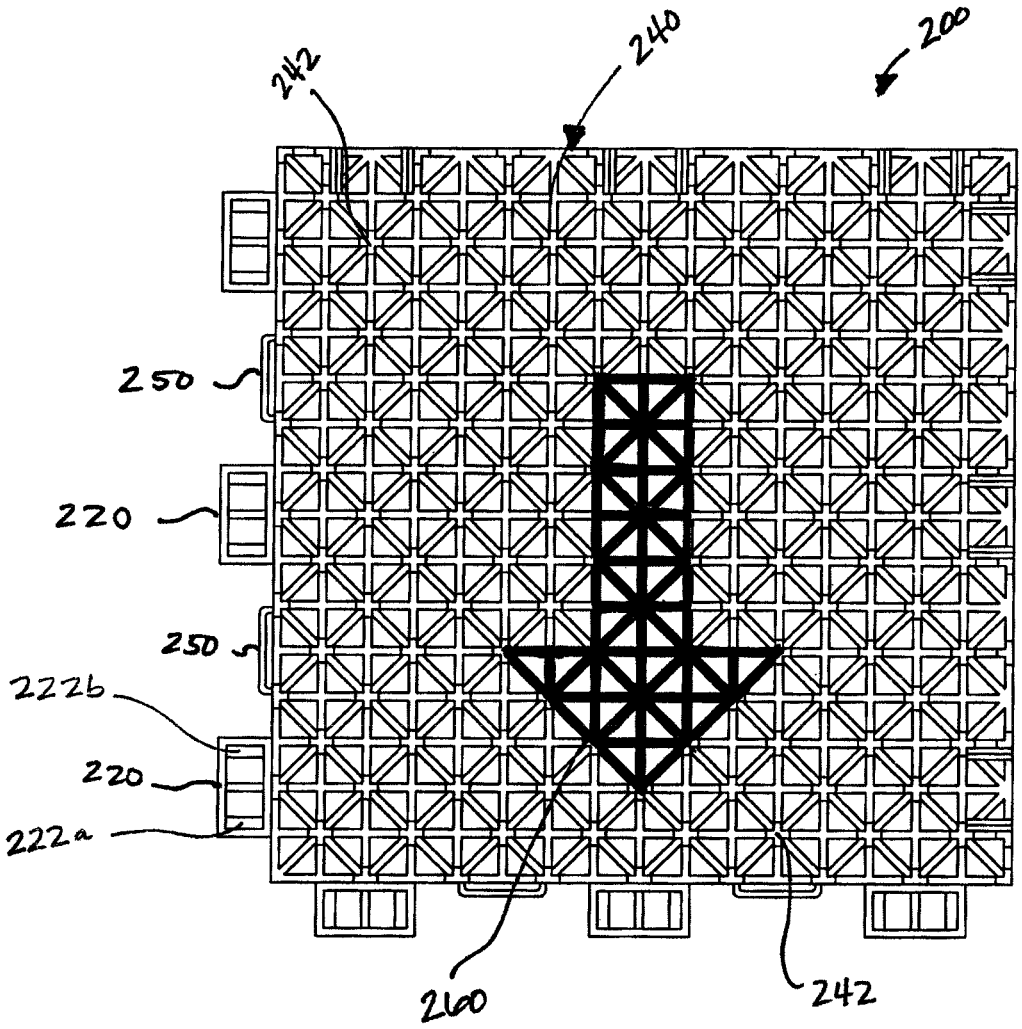
FIG. 2B is a bottom view of the tile member of FIG. 2*a*.

FIG. 2B shows the support structure 240 which is be located beneath the top surface 210 of the tile member 200. The support structure 240 may be comprised of a plurality of reinforcement elements 242 extending away from the top surface 210. In use, the reinforcement elements 242 sit on top of a ground surface and support the tile member 200 when pressure is applied to the surface 210, further preventing permanent disfigurement or crumpling.

Each tile member 200 may be approximately one-foot square. However, the members 200 may be larger or smaller (e.g., 8", 9", 10", 11", 13", 14", etc.) and may include other shapes, including but not limited to polygonal or rectangular.

The tile members 200 may be injected molded out of a high impact polypropylene copolymer, although other suitable materials may be used, including aluminum, polyethylene, polystyrene, polycarbonate, et cetera. Thus, the tile members may be generally rigid, but somewhat elastic to allow for slight movements of the tile members. The tile members 200 may further be cuttable into particular shapes to conform to the area being covered.

Figure 4:
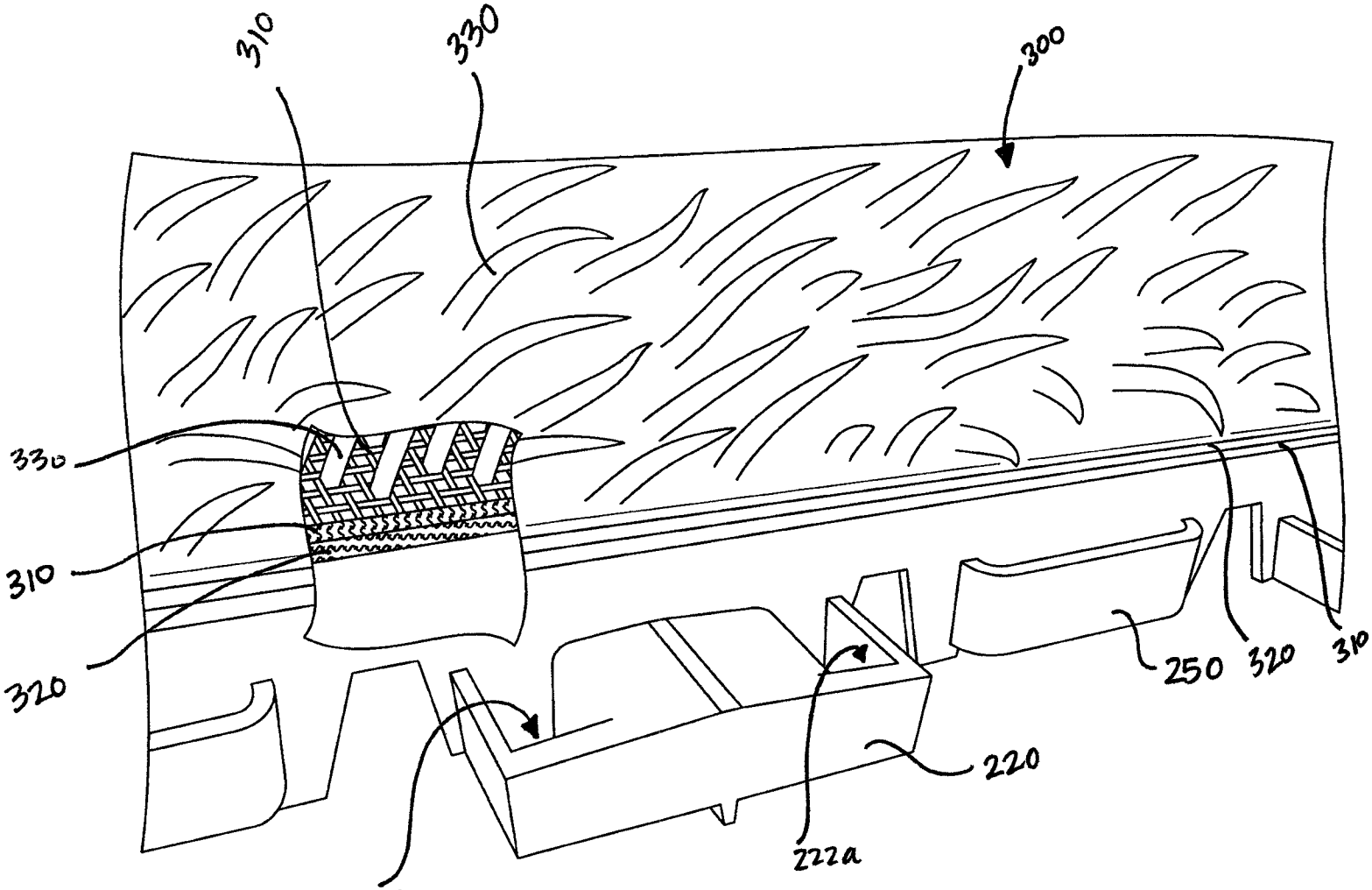
FIG. 4 is a magnified view of the turf and tile system, showing the layers of the artificial turf.

With reference to FIG. 4, the turf arrangement 300 may be comprised of a primary backing 310, a secondary backing 320, and fibers 330. The primary backing 310 may be, for example, a stabilized dual-layered woven polypropylene. The fibers 330, which may be, for example, polyethylene, are tufted into the primary backing 310 in a known manner such that one end extends outward from the primary backing 310.

The secondary backing 320 may be, for example, a hot melt polyolefin. The secondary backing 320 is attached to the primary backing 310 via an adhesive to further secure the fibers 330 in the primary backing 310 and to provide an even surface for adhering the turf arrangement 300 to the tile members 200. Both the primary backing 310 and the secondary backing 320 may be configured to allow water to escape through the backings 310, 320.

Alternately, the turf arrangement 300 may be comprised of a single backing 310 into which the fibers 330 may be tufted. The single backing 310 and the fibers 330 may be directly adhered to the tile members 200.

Figure 3A:
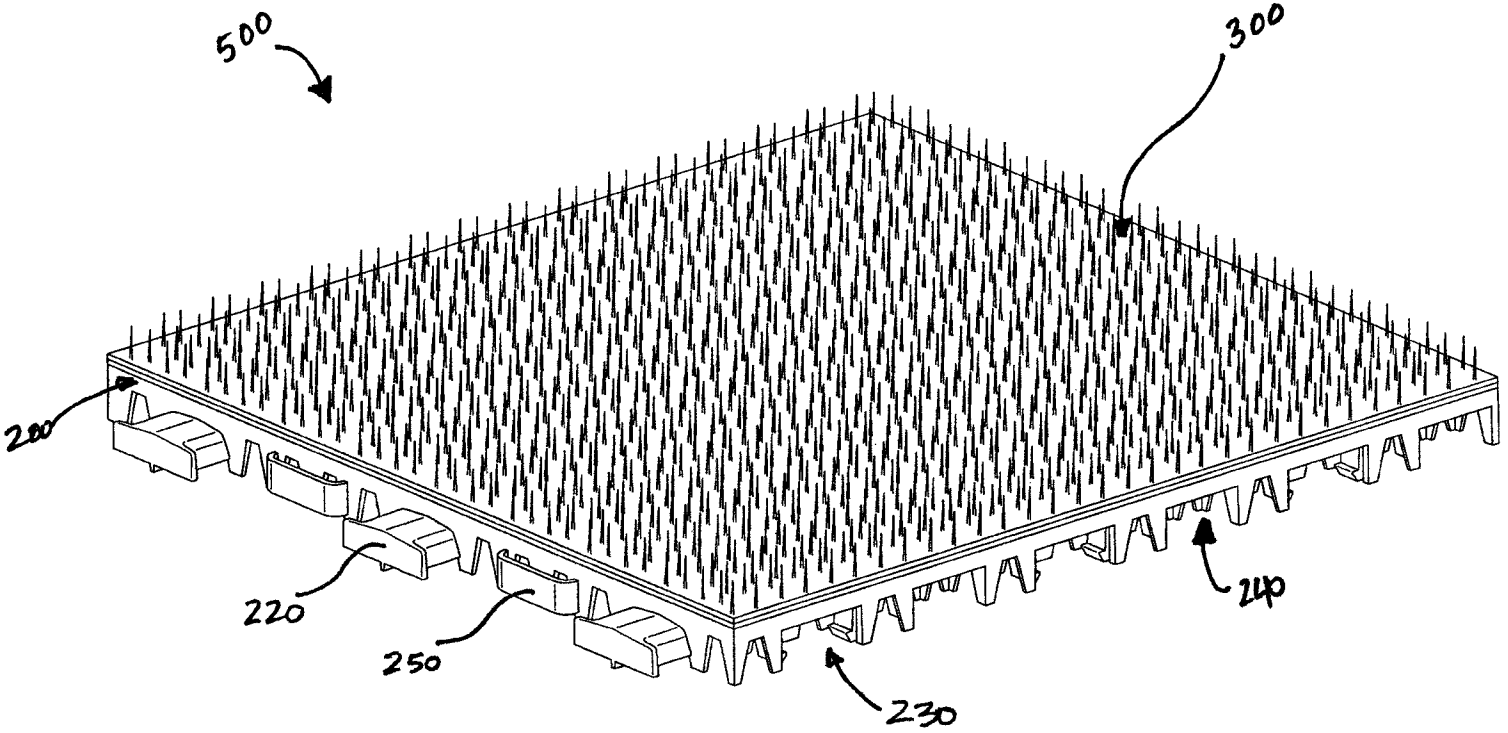
FIG. 3A is a top perspective view of the artificial turf and tile system.
Figure 3B:
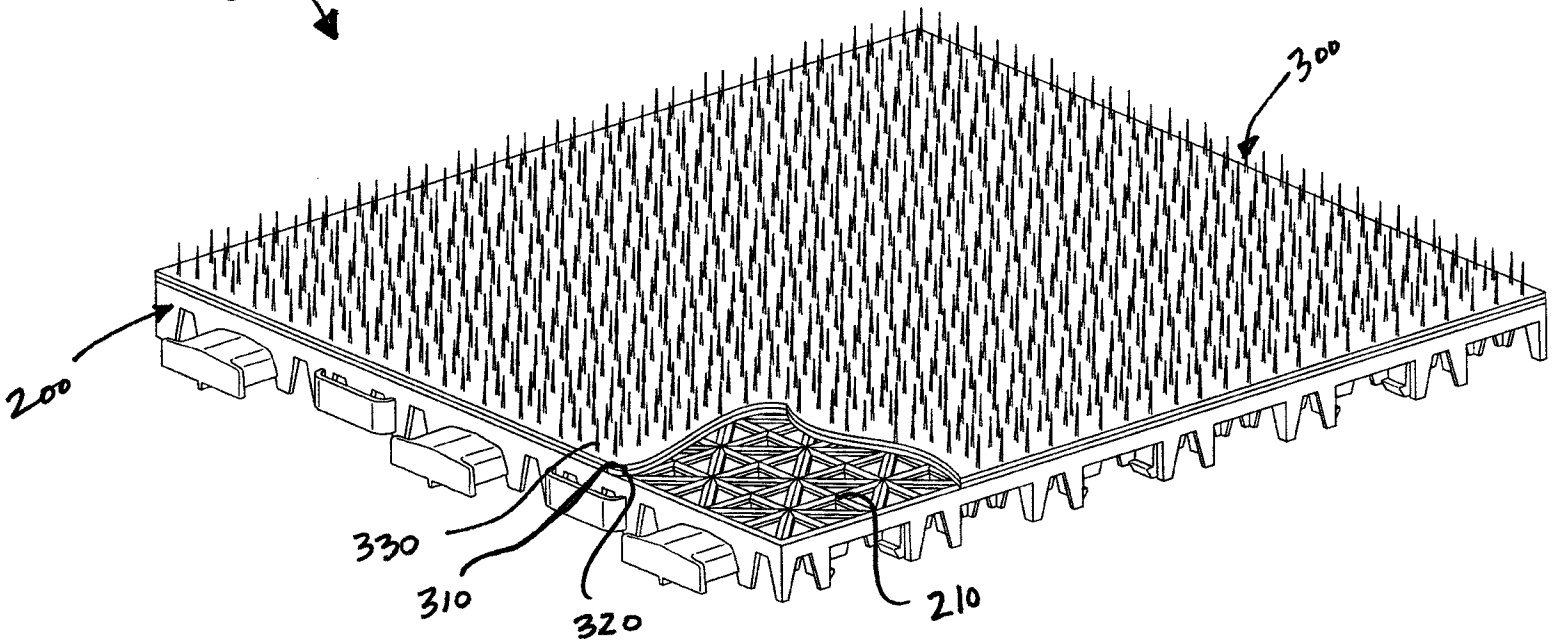
FIG. 3B is a top perspective view of the artificial turf and tile system showing the tile member beneath the artificial turf.

As is further described below, the turf arrangement 300 may be adhesively fixed to the top surface 210 of the tile members 200 to form a tile-and-turf assembly 500, as shown in FIGS. 3A and 3B. More specifically, FIG. 3A illustrates a single tile member 200 covered by the synthetic turf assembly 300. FIG. 3B further illustrates the details of the turf 300, showing the primary backing 310 and the secondary backing 320 fixed to the tile member 200. The adhesive may be any waterproof adhesive capable of permanently binding the turf arrangement 300 to the tile members 200.

Figure 6:
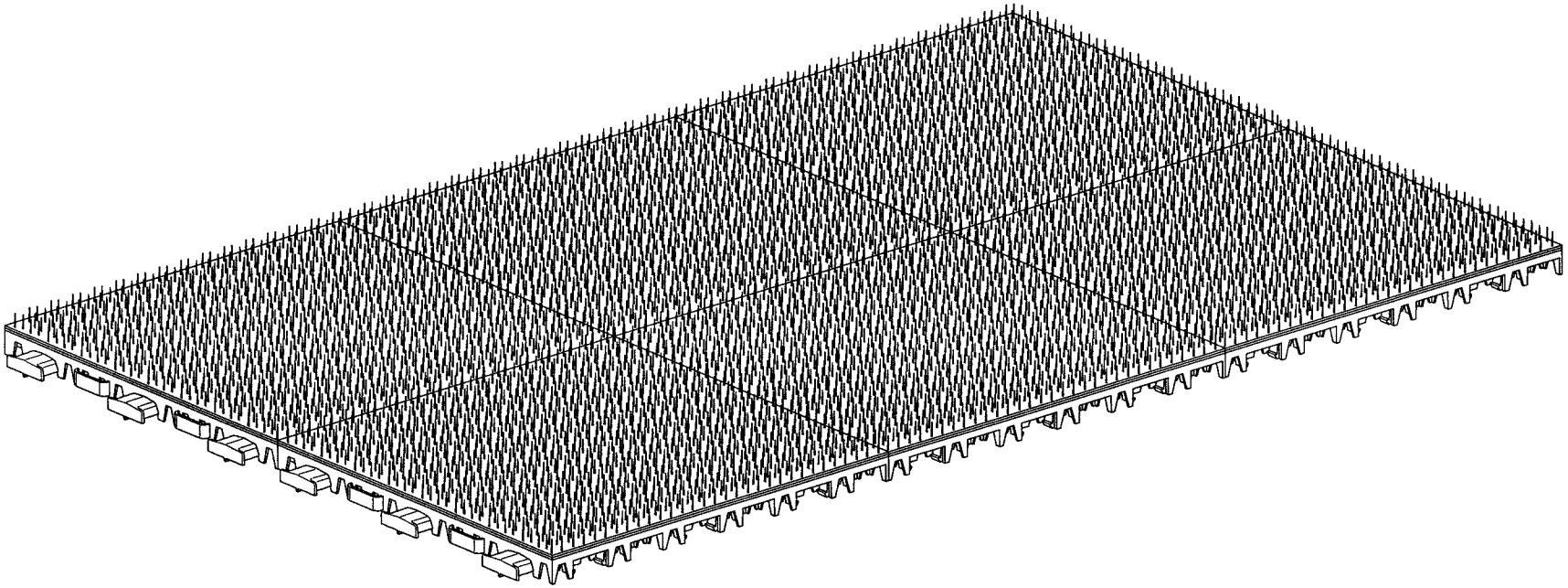
FIG. 6 is a flow diagram of the method of creating the turf and tile system.

FIG. 6 illustrates the process of creating a modular synthetic grass installation system. The process begins at step 602, where a plurality of interconnecting tile members 200 is provided. At step 604, the tile members 200 are secured together via the male couplers 220 and the female couplers 230 as described above to form a grid. The size of the grid is not essential, and may be determined by, for example, shipping requirements, storage limitations, square footage specifications, et cetera. The turf arrangement 300 may be provided in, for example, 15-foot wide rolls, and thus the benefits of conforming the grid dimensions to that of the turf arrangement 300 may be apparent to those skilled in the art. The process then moves to step 606.

At step 606, the adhesive is applied to the top surface 210 of the tile members 200. As the adhesive is applied to the top 210 of the tile members 200, voids 215 (FIG. 2A) in the skeletal structure of the top surface 210 of the tile members 200 allow the excess adhesive to drip through. Ultimately, when the tiles 200 are installed outdoors, water introduced to the assembly may flow through the voids in the synthetic turf 300 and then towards drainage.

Moving on, at step 608, the artificial turf 300 is rolled onto the top surface 210 of the tile members 200 and the adhesive is subsequently allowed to dry, thus creating the tile-and-turf assembly 500. The assembly 500 is embodied in FIG. 3A, which shows a single tile member 200 with the turf 300 adhered thereto. The process then moves to step 610.

At step 610, the assembly 500 is turned over such that the turf 300 is on the bottom and the undersides 240 of the tile members 240 are facing upwards. Direction indicators 260 (FIG. 2B) may be provided on the underside 240 of the structure 500 to represent the proper installation direction. The direction indicators 260 may be printed on the underside 240 of each individual tile member 200 or may be printed on a predetermined number or pattern of members 200. For example, the direction indicators 260 may be printed on every other tile member 200 or every third tile member 200. The structure is then flipped back over so that the turf 300 is again on top, and the process moves to step 612.

Figure 5:
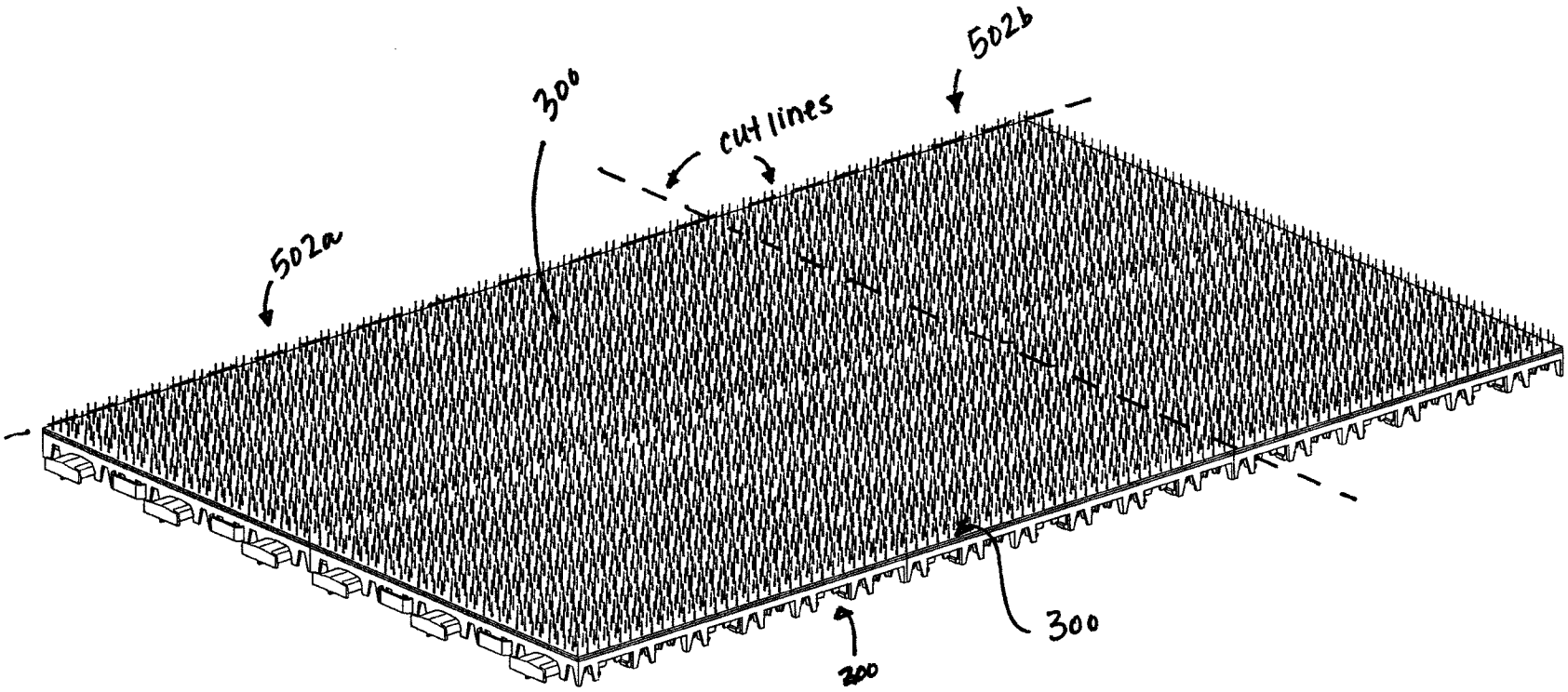
FIG. 5 is a top perspective view of the turf and tile system showing cut lines.

At step 612, as illustrated in FIG. 5, the structure 500 is cut into palletizable sections 502*a*, 502*b* based on the requirements of the pallet. For example, a pallet may support a 4×4 section 502*a*, 502*b* (i.e., 16 tiles 200). Alternately, the sections 502*a*, 502*b* may be, for example, 2×2, 3×3, 5×5, et cetera. However, the advantage of the sections 502*a*, 502*b* being easily transportable and assembled by an individual may be evident to those having skill in the art.

The sections 502*a*, 502*b* are cut from the grid by first cutting the turf 300 along edges of the snapped together tiles 200 based on the predetermined size of the sections 502*a*, 502*b*. When the turf 300 is cut, the tiles 300 may be separated (i.e., unsnapped), thus creating the separated sections 502*a*, 502*b*. Alternatively, the turf 300 may be cut and the tiles 300 separated simultaneously.

At step 614, a predetermined number of sections, as described above, are laid onto and then secured to the pallet 400, and the process ends.

Various methods may be used to separate the structure 500 into sections 502*a* and 502*b*. In one example, the turf 300 is cut between the edges of the interconnected tile members 200 based on the predetermined size of the section (e.g., 4 tiles×4 tiles (hereinafter 4×4)), as illustrated in FIG. 5 as the "cut line". The tile members 200 are then separated along the cut lines by unsnapping the female couplers 230 from the male couplers 220 as described above. Alternately, it may be possible to both cut the turf 300 and separate the tile members 200 at the same time. Having separated the structure 500 into sections, the process moves to step 614.

At step 614, the sections 502*a*, 502*b* are placed atop the pallet 400 and secured for storage or shipping. The number of sections 502*a*, 502*b* placed atop the pallet 400 may be determined based upon the requirements of a retailer. For example, Retailer A may only have enough space for 10 pallets having dimensions of 4'W×4'L×3'H. Thus, 4×4 sections 502*a*, 502*b* may be placed onto the pallet 400 until the height reaches three feet. Alternately, Retailer B may wish to sell pallets 400 having 500 square feet worth of the tile-and-turf assembly 500. Thus, 125 4×4 sections 502*a*, 502*b* would be placed onto the pallet 400. The sections 502*a*, 502*b* may be secured onto the pallet 400 by, for example, shrink wrap. It may also be noted the sections 502*a*, 502*b* may be stored or shipped via any other suitable method, including but not limited to boxes or crates.

In use, the area to be covered by the assembly 500 is prepared by scraping the sod from the ground. The ground may be leveled so as to provide an even surface upon which to lay the tile-and-turf assembly 500. Once the ground has been prepared, the installer may remove the first section 502*a* from the pallet 400, and position the section 502*a* as needed upon the ground. A second section 502*b* is taken from the pallet 400 and secured to the first section 502*a* as described above. This continues until the entire area is covered.

As the shape of the area to be covered may not be perfectly square, the sections 502*a*, 502*b* may be cut to the specifications of the area using a sharp knife or saw. Thus, although the assembly 500 may be provided in square sections 502*a*, 502*b*, many areas having unique shapes and sizes may be accurately covered. Mulch may be laid around the edges of the assembly to hide the sides of the tile members 200.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. Not all steps listed in the various figures need be carried out in the order described.

What is claimed is as follows:

1. An artificial turf tile system, comprising:
- a plurality of connectable tile members; and
- a synthetic turf arrangement adhered to the tile members,
- wherein the interconnected tile members having the turf attached thereto are cut into sections; and
  - the sections are secured on a pallet for sale at a retail establishment; and wherein:
  - the synthetic turf arrangement comprises:
    - a primary backing;
    - a secondary backing; and
    - a plurality of fibers interlaced into the primary backing and secured into place by the secondary backing, the secondary backing being adhesively fixed to the primary backing on a first said and adhered to the tile member on a second side;
  - the primary backing and the secondary backing are configured to be permeable to allow for drainage; and
  - the primary backing and the secondary backing do not have holes punched therein.

2. The system of claim 1, wherein each tile member has a top surface, a bottom surface, a first, second, third, and fourth margin, wherein the first and second margins are adjacent and have a plurality of male couplers, and the third and fourth margins are adjacent and have a plurality of female couplers.

3. The system of claim 2, wherein the male couplers further comprise a first aperture, a second aperture, and a central portion defined between the first and second apertures.

4. The system of claim 3, wherein the female couplers further comprise a first spring latch and a second spring latch, and a receiving area defined between the first and second spring latches.

5. The system of claim 4, wherein the spring latches of a first female coupler located along the third margin of a first tile member are received into the apertures of a first male coupler located along the first margin of a second tile member, and wherein the receiving area of the first female coupler receives the central portion of the first male coupler.

6. The system of claim 5, wherein the spring latches of a second female coupler located along the third margin of a third tile member are received into the apertures of a second male coupler located along the second margin of the second tile member, and wherein the receiving area of the second female coupler receives the central portion of the second male coupler.

7. The system of claim 6, wherein the female couplers are releasable from the male couplers.

8. The system of claim 7, wherein the primary backing of the turf arrangement is adhered to the tile members using a waterproof adhesive.

9. The system of claim 7, wherein the secondary backing of the turf arrangement is adhered to the tile members using a water proof adhesive.

10. The system of claim 9, wherein the tile members having the turf arrangement secured thereto is separated into sections, each section comprising at least one tile member.

11. The system of claim 1 wherein the tile members having the turf arrangement attached thereto are cuttable.

12. A method for producing a modular synthetic grass tile system comprising the steps of:
- (a) providing a plurality of tile members;
- (b) snapping the tile members together at their edges to form a grid; and
- (c) adhering a sheet of synthetic turf to the top surface of the tile members, the synthetic turf comprising:
  - a primary backing;
  - a secondary backing; and
  - a plurality of fibers;
  - wherein the plurality of fibers are interlaced into the primary backing and secured into place by the secondary backing; the secondary backing being adhesively fixed to the primary backing: and
  - wherein in primary backing and the secondary backing are permeable to allow for drainage and do not have holes punched therein.

13. The method of claim 12, wherein the synthetic turf arrangement is adhered to the tile members using an adhesive.

14. The method of claim 12, further comprising the steps of:
- (d) printing direction indicators onto an underside of the tile members;
- (e) cutting the turf arrangement along a first cut line and a second cut line, the first and second cut lines corresponding to the edges of selected snapped together members;
- (f) separating the tile members along the cut lines to form a plurality of sections; and
- (g) securing a predetermined number of the sections onto a pallet.

15. The method of claim 12, wherein each tile member has a top surface, a bottom surface, a first, second, third, and fourth margin, wherein the first and second margins are adjacent and have a plurality of male couplers, and the third and fourth margins are adjacent and have a plurality of female couplers.

16. The method of claim 14, wherein steps (e) and (f) occur simultaneously.

17. An artificial turf tile system, comprising:
- a tile member comprising:
  - a top surface having a plurality of holes formed therein;
  - a bottom surface having a plurality of supporting structures extending therefrom;
  - four sides, two of the four sides equipped with male couplers and the other two sides equipped with female couplers;
- a synthetic turf arrangement comprising:
  - a plurality of fibers interlaced into a first polyolefin woven backing system;
  - a second porous polyolefin backing system adhered to the first polyolefin backing system via a polyethylene adhesive;
- wherein:
  - the synthetic turf arrangement is adhered to the tile member such that water is allowed to flow through the tile member and synthetic turf arrangement;

and holes are not punched in the first or second backing systems.

* * * * *